US012172097B1

(12) United States Patent
Ruggiero et al.

(10) Patent No.: US 12,172,097 B1
(45) Date of Patent: Dec. 24, 2024

(54) BUBBLE BLOWING TOY

(71) Applicant: Sunny Days Entertainment, LLC, Simpsonville, SC (US)

(72) Inventors: Jim Ruggiero, Simpsonville, SC (US); Ka Shun Lo, Tsuen Wan (HK)

( * ) Notice: Subject to any disclaimer, the term of this patent is extended or adjusted under 35 U.S.C. 154(b) by 14 days.

(21) Appl. No.: 17/500,388

(22) Filed: Oct. 13, 2021

(51) Int. Cl.
*A63H 33/28* (2006.01)

(52) U.S. Cl.
CPC ..... *A63H 33/28* (2013.01)

(58) Field of Classification Search
CPC ..... A63H 33/28
USPC ..... 446/15, 16
See application file for complete search history.

(56) References Cited

U.S. PATENT DOCUMENTS 5,462,469 A * 10/1995 Lei ..... A63H 33/28 446/15
5,498,191 A * 3/1996 DeMars ..... A63H 33/28 446/178
6,059,629 A * 5/2000 Lin ..... A63H 33/28 446/15
6,093,075 A * 7/2000 Lin ..... A63H 33/28 446/16
6,287,165 B1 * 9/2001 Lin ..... A63H 33/28 446/16
6,386,935 B1 * 5/2002 Lin ..... A63H 33/28 446/16
6,439,944 B1 * 8/2002 La Fata ..... A63H 33/28 446/15
6,616,498 B1 * 9/2003 Thai ..... A63H 33/28 446/15
6,682,570 B2 * 1/2004 Thai ..... A63H 33/28 446/15
6,860,782 B2 * 3/2005 Hornsby ..... A63H 33/28 446/15
6,905,386 B2 * 6/2005 Thai ..... A63H 33/28 446/16
6,921,312 B2 * 7/2005 Thai ..... A63H 33/28 446/176
7,056,182 B2 * 6/2006 Wan ..... A63H 33/28 446/15
7,059,930 B2 * 6/2006 Choi ..... A63H 33/28 446/178

(Continued)

FOREIGN PATENT DOCUMENTS

CN 104922917 B 5/2018
EP 2921213 B1 8/2018

*Primary Examiner* — Joseph B Baldori
(74) *Attorney, Agent, or Firm* — Waddey Acheson; Ira C. Waddey, Jr.; G. Edward Powell

(57) ABSTRACT

A bubble blowing apparatus comprising a main body housing, a handle integral to a lower portion of the main body housing, a motor, a fan operably coupled to the motor, the fan being positioned to blow a stream of air outward from a front portion of the main body housing, a pump mechanism operably coupled to the motor, a bubble wand operably coupled to the motor, a trigger that is operable to activate the motor, a bubble solution container, a liquid supply tube operably coupled to the pump mechanism and configured to supply liquid from the bubble solution container to the bubble wand, and a liquid return tube configured to return excess liquid from the bubble wand to the bubble solution container. The bubble wand may further comprise a pair of independent arcuate bubble blade members.

20 Claims, 6 Drawing Sheets

(56) References Cited

U.S. PATENT DOCUMENTS

| | | | | |
|---|---|---|---|---|
| 7,086,920 | B2 * | 8/2006 | Fusco | A63H 33/28 446/15 |
| 8,690,630 | B2 * | 4/2014 | Lau | A63H 33/28 446/15 |
| 8,888,549 | B2 * | 11/2014 | Lo | A63H 33/28 446/16 |
| 9,050,544 | B2 * | 6/2015 | Chen | A63H 33/28 |
| 9,089,785 | B2 * | 7/2015 | Orem | A63H 33/28 |
| D744,349 | S | 12/2015 | Huey | |
| D745,322 | S | 12/2015 | Huey | |
| 9,339,737 | B2 | 5/2016 | Chan | |
| 9,757,661 | B2 | 9/2017 | Chan | |
| 9,878,262 | B2 | 1/2018 | Chan | |
| 9,884,262 | B2 | 2/2018 | Huey | |
| 10,434,433 | B1 * | 10/2019 | Thai | A63H 33/28 |
| 10,807,015 | B2 | 10/2020 | Chan | |
| 2007/0037467 | A1 * | 2/2007 | Thai | A63H 33/28 446/15 |
| 2009/0142986 | A1 * | 6/2009 | San | A63H 33/28 446/15 |
| 2012/0208426 | A1 * | 8/2012 | Kuo | A63H 33/28 446/15 |
| 2014/0024282 | A1 * | 1/2014 | Lin | A63H 33/28 446/15 |
| 2014/0141688 | A1 * | 5/2014 | Kelly | A63H 33/28 446/15 |
| 2014/0364032 | A1 * | 12/2014 | Kelly | A63H 33/28 446/15 |
| 2019/0192989 | A1 * | 6/2019 | Kelly | A63H 33/28 |
| 2022/0143525 | A1 * | 5/2022 | Lo | A63H 33/28 |

* cited by examiner

BUBBLE BLOWING TOY

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to a toy. More particularly, the present disclosure relates to a toy that functions as a battery-powered bubble blowing apparatus that is capable of automatically forming and rapidly blowing a significant number of large sized bubbles closely.

Various types of bubble blowing machines are well-known in the art. Conventional toy bubble blowing machines typically include, at a minimum, a source of bubble-forming liquid and some type of ring shaped dipper to pick up and disperse the bubble-forming liquid. Such bubble blowing machines take all kinds of shapes and sizes. Some of these toys include push/pull-type bubble blowers that rely on the physical application of force to activate the creation of bubbles, such as "bubble lawn-mowers" that create bubbles when pushed by a child. Others take the shape of simple bubble wands that can be manually dipped in a bubble solution and blown by the user to create bubbles. Still, other types include stand-alone type units, which are capable of resting independently on the ground and automatically forming and blowing a number of bubbles upon activation by a user, and bubble "shooters" that take the shape of a gun and typically rely on mechanically activated or battery-powered trigger-pull mechanisms to form and shoot the bubbles.

However, each of these types of bubble blowers typically come with their own variety of problems. For example, the use of simple wands results in the unnecessary and undesirable loss of unused bubble solution when excess bubble solution collected on the wand drips off the want onto the ground or a user's body when the user is blowing air into the wand to form bubbles. Also, breath-actuated bubble devices such as wands can result in users getting tired or light-headed from exhaling too much air in too short a time. Because stand-alone type bubble blowing units generally only require being filled with bubble solution and "turned on" before they make bubbles, children users may become unengaged with the stand-alone bubble toy once it has been activated. Another further problem with these stand-along type blowers is that they are not mobile or as mobile as other types of existing bubble blowing machines.

The push/pull-type bubble blowers may also not be ideal due to the fact that they are often unable to create a relatively continuous stream of bubbles without the continuous application of force by the user. These mechanically activated push/pull-type blowers, such as the bubble "lawnmowers" and wind-up blowers, typically require a substantial degree of energy and effort to maintain a steady output of fully formed bubbles. They must be physically moved by the user with sufficient enough speed and force to activate and operate the blower's internal bubble making/blowing mechanisms. Failure to move these types of mechanically activated blowers with sufficient enough force will result in the blower's failure to produce bubbles. Requiring such levels of maintained effort from certain users can often lead to these users becoming physically exhausted and tired of the bubble making process. Further, currently existing bubble blowers can and often become messy when trying to add new bubble solution, and can be difficult to use and expensive to manufacture.

What is needed then are improvements to toy bubble blowing machines that address these and other problems.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is a bubble blowing apparatus. In an embodiment, the bubble blowing apparatus can comprise a main body housing, a handle integral to the main body housing, a motor, a fan, a pump mechanism, a bubble wand, a trigger located on the handle that is operable to activate the motor, a bubble solution container, a liquid supply tube that supplies a liquid from the bubble solution container to the bubble wand, and a liquid return tube that returns excess unused liquid from the bubble wand back into the bubble solution container. In some embodiments, a liquid catch basin may additionally be provided underneath the bubble wand in order to aide in the capture and return of excess and/or unused bubble solution to the bubble solution container-thereby preventing the excessive waste of unused bubble solution. In an exemplary embodiment, the fan can be positioned to blow a stream of air outward from a front portion of the main body housing, and the bubble wand may comprise two bubble blade members. In this exemplary embodiment, the two bubble blade members are each operably coupled to the motor and configured to repetitively cycle between (1) a closed starting position in which the bubble wand amasses bubble solution, and (2) an open position in which the amassed bubble solution contacts the outwardly blown stream of air and forms a bubble. In this manner, a continuous stream of fully formed bubbles are created.

Another aspect of the disclosure is a method for blowing bubbles. Such a method may comprise providing a bubble blowing apparatus, providing a bubble solution, activating the motor of the bubble blowing apparatus, and continuously rotating the bubble wand, such that the bubble wand repetitively cycles between (1) a closed starting position in which the bubble wand amasses bubble solution, and (2) an open position in which the amassed bubble solution contacts the outwardly blown stream of air and forms a bubble.

Numerous other objects, advantages and features of the present disclosure will be readily apparent to those of skill in the art upon a review of the following drawings and description of a preferred embodiment.

DETAILED DESCRIPTION

Figure 1:
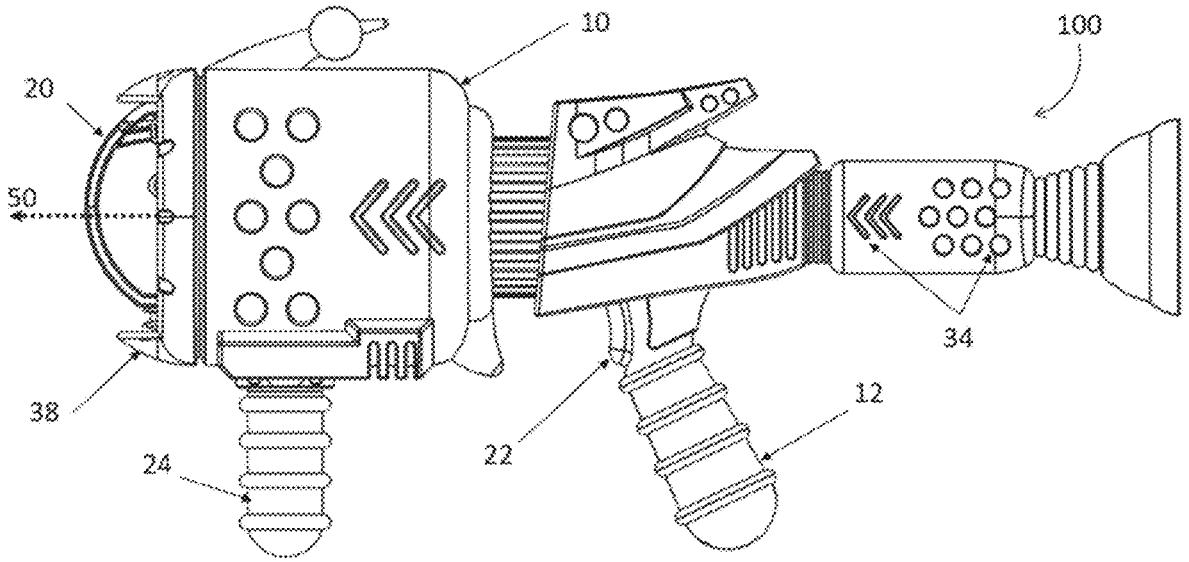
FIG. 1 is a side view of an embodiment of a bubble blowing apparatus.
Figure 2:
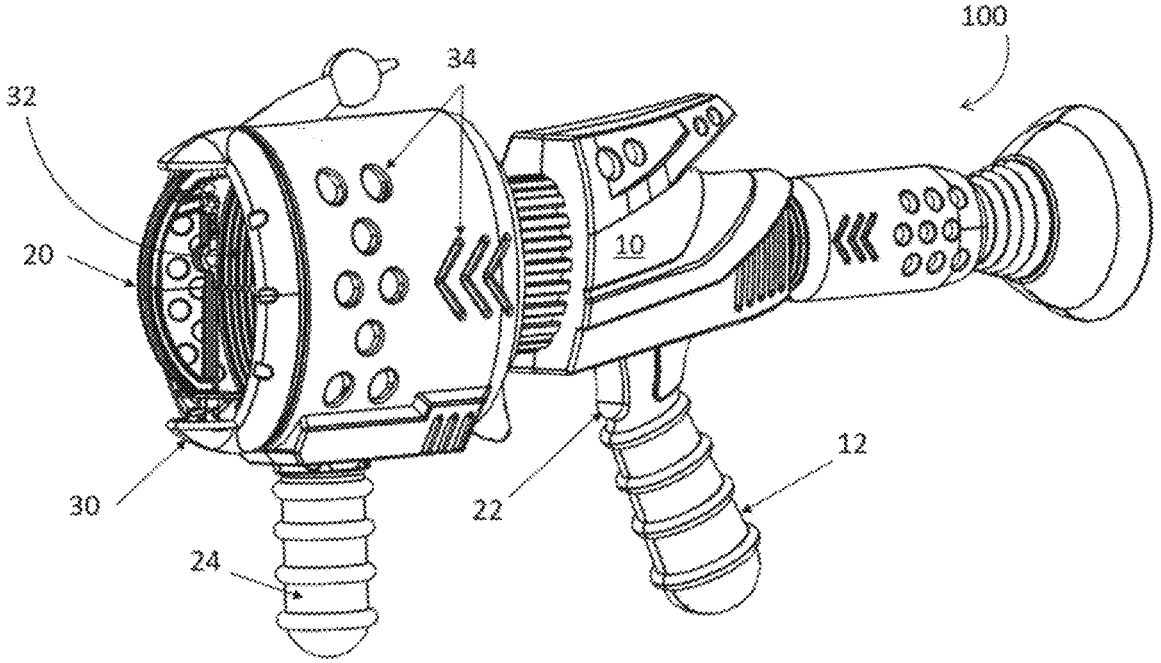
FIG. 2 is a perspective view of an embodiment of a bubble blowing apparatus.
Figure 3:
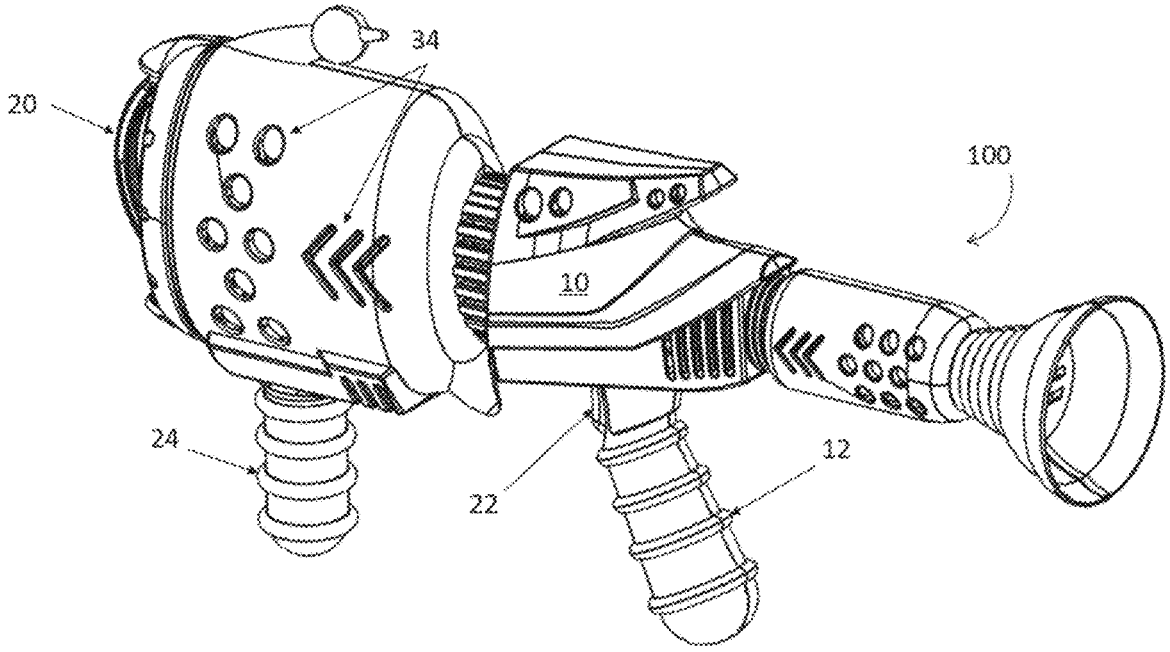
FIG. 3 is a perspective view of an embodiment of a bubble blowing apparatus.
Figure 4:
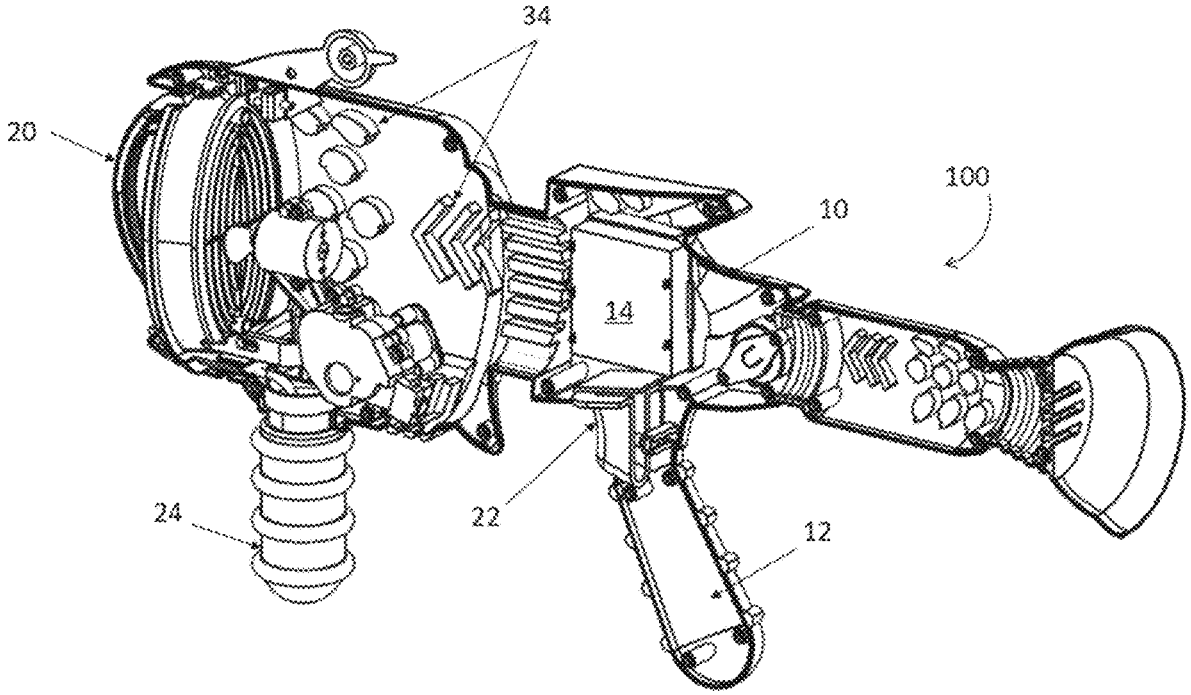
FIG. 4 is a perspective view of an embodiment of a bubble blowing apparatus with half of its main body housing removed.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

Referring now to the drawings, FIGS. 1 through 6 illustrate a variety of different views of an embodiment of a bubble blowing apparatus 100. In an exemplary embodiment, the bubble blowing apparatus 100 may include a main body housing 10, a handle 12, a motor 14, a fan 16, a pump mechanism 18, a bubble wand 20, a trigger 22 that is operable to activate the motor 14, a bubble solution container 24 for holding a bubble solution liquid, a liquid supply tube 26, a liquid return tube 28, a liquid return catch basin 30. In such embodiments, the handle 12 may be integrally formed into a lower portion of the main body housing 10. Also in such embodiments, the fan 16, pump mechanism 18, bubble wand 20, and liquid supply tube 26 are each operably coupled to the motor 14 by electrical wiring 36. Fan 16 should be positioned such that it is capable of blowing a stream of air in a generally forward direction 50 that is outward from the front portion of the main body housing 10. To increase the safety level of apparatus 100 for child users, a fan guard 32 may be included in a location between the fan 16 and the bubble wand 20. To help make bubble blower apparatus 100 more attractive and engaging to child users, a plurality of decorative design elements 34 and/or designs may additionally be included on and around the main body housing 10.

Figure 6:
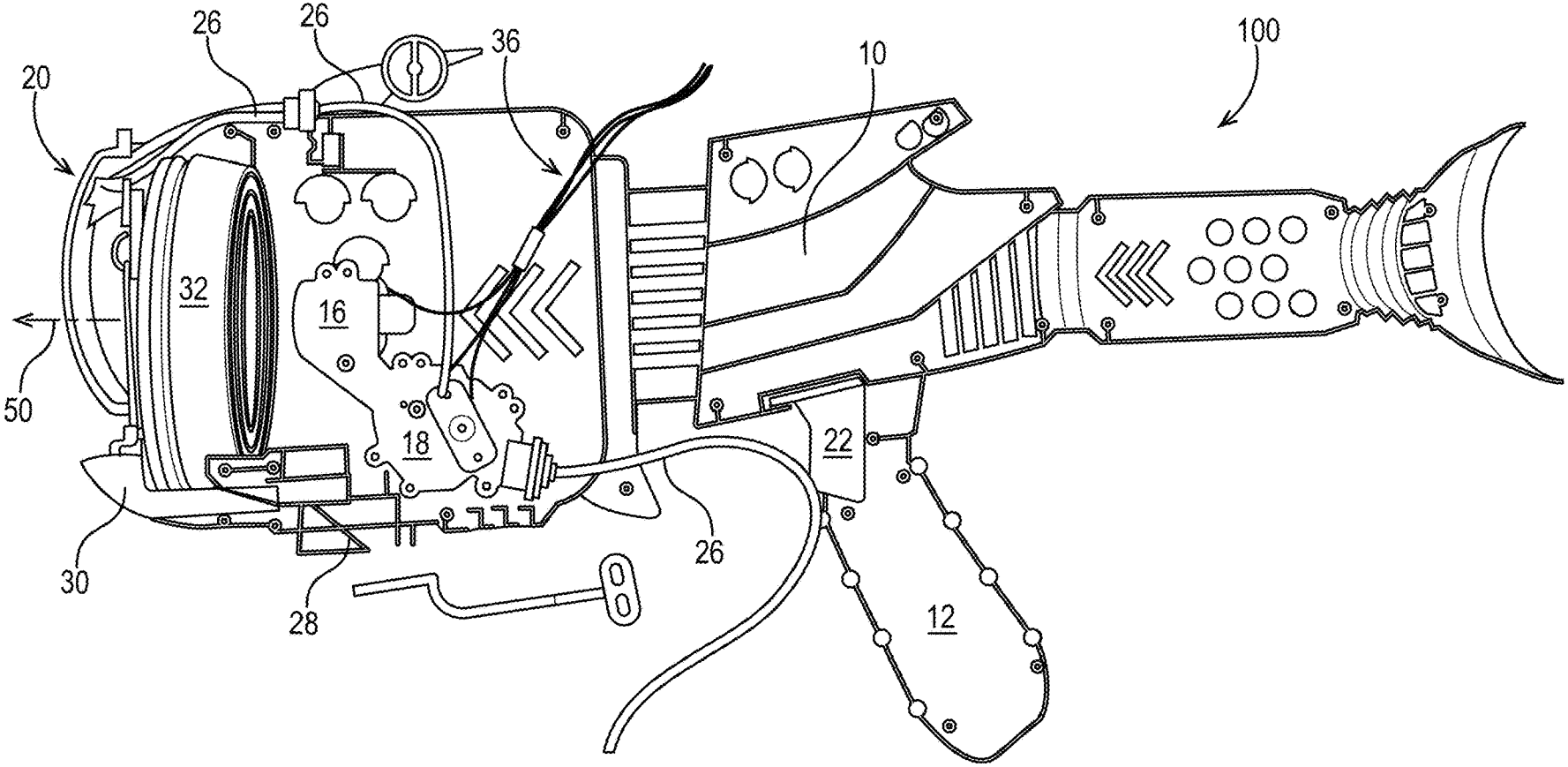
FIG. 6 is a side view of an embodiment of a bubble blowing apparatus with half of its main body housing removed.
Figure 8:
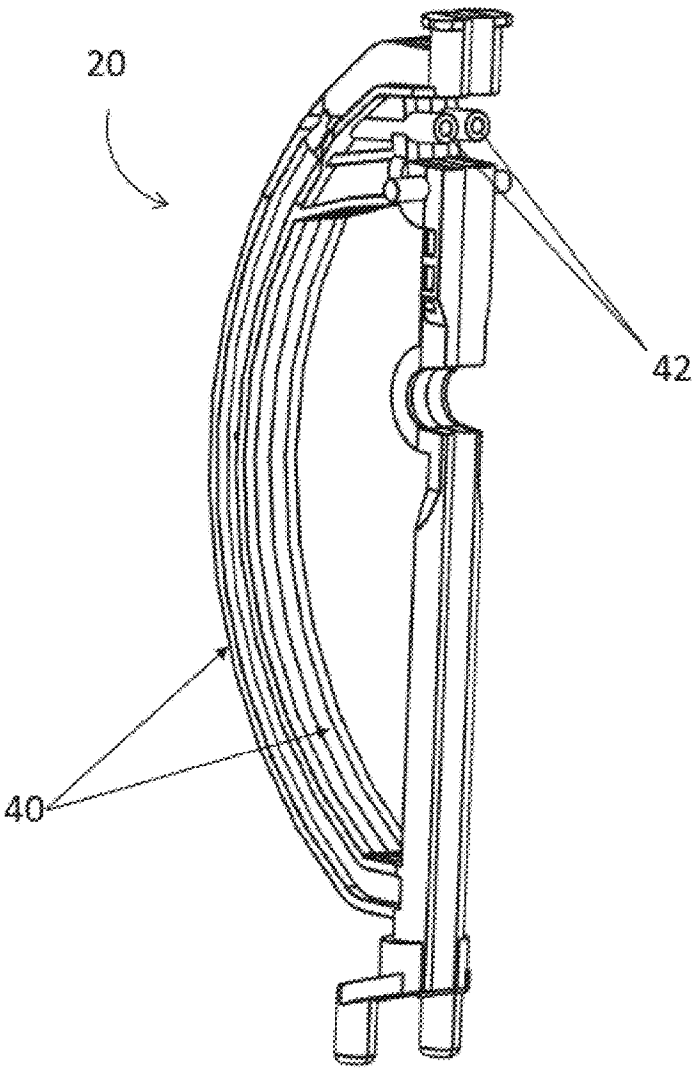
FIG. 8 is an isolated perspective view of an embodiment of a bubble wand in a closed position.

As seen in FIG. 6, liquid supply tube 26 may be operably coupled to pump mechanism 18 and configured to supply bubble solution liquid from the bubble solution container 24 to the bubble wand 20. Thus, in such embodiments, one end of liquid supply tube 26 will be located inside of the bubble solution container 24 while the opposing end of supply tube 26 will be connected to the bubble wand 20. In this arrangement, the pump mechanism 18, once activated by motor 14, will pump the bubble solution liquid through the liquid supply tube 26—from the bubble solution container 24 to the bubble wand 20. The bubble wand 20 is at least partially responsible for the creation of bubbles.

Figure 5:
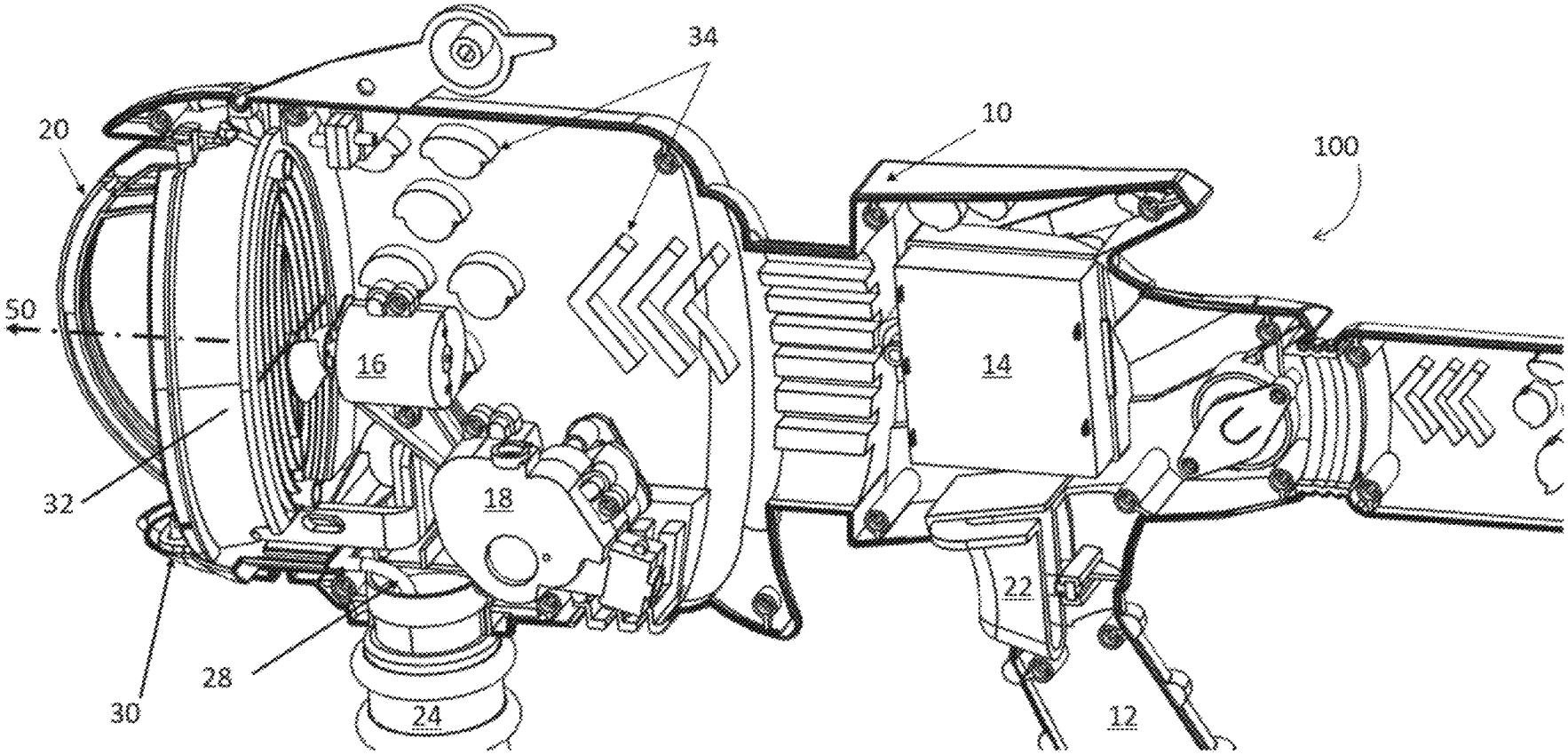
FIG. 5 is a more detailed perspective view of the interior components of an embodiment of a bubble blowing apparatus.
Figure 7:
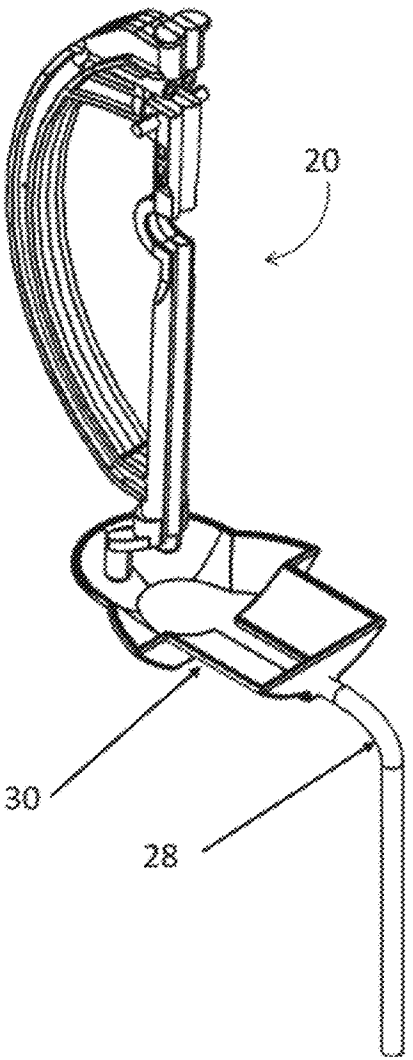
FIG. 7 is an isolated perspective view of an embodiment of a bubble wand in a closed position.

In some embodiments, such as those shown in FIGS. 5-7, a liquid return catch basin 30 may be included in a location underneath the bubble wand 20. Liquid return catch basin 30 can be bowl-shaped and configured to capture unused or excess bubble solution liquid that drains off of the bubble wand 20. Liquid return catch basin 30 can be coupled to the liquid return tube 28 and arranged such that the unused excess bubble solution that drains off of bubble wand 20 collects in basin 30 and flows through liquid return tube 28 and back into the bubble solution container 24 to be recycled for reuse, as opposed to going to waste. This helps to minimize the overall amount of bubble solution that is required to operate the bubble blowing apparatus 100 over a set period of time. Thus, in such embodiments, one end of liquid return tube 28 will be in fluid communication with liquid return catch basin 30 while the other end of the liquid return tube 28 will be in fluid communication with bubble solution container 24. In further embodiments, the bubble solution container 24 can be capable of detachably coupling to the main body housing 10. In an embodiment, this detachable coupling can be accomplished by providing a threaded screw-in engagement between a portion of the bubble solution container 24 and main body housing 10. In this manner, once bubble solution container 24 runs out of bubble liquid during the continued operation of bubble blower apparatus 100, the empty solution container 24 can simply be removed from the main body 10 replaced with a brand new pre-filled bubble solution container 24. Alternatively, the empty bubble solution container 24 could be unscrewed and removed from the main body 10, refilled with more bubble liquid, and screwed back in place on the main body 10, thereby reducing the amount of waste that is otherwise created by using brand new bubble solution container 24 replacements every time.

The bubble wand 20 may take a variety of shapes and forms. In the exemplary embodiment depicted in FIGS. 7-10, bubble wand 20 may comprise two arcuate bubble blade members 40. In this exemplary embodiment, both of the arcuate bubble blade members 40 may be identical mirror images of each other and further comprise a liquid supply opening 42 located at a top portion of each arcuate bubble blade member 40. In the partially assembled embodiment of apparatus 100 depicted in FIG. 6, each of the liquid supply openings 42 of the two arcuate bubble blade members 40 are in fluid connection with one end of liquid supply tube 26, while the other end of liquid supply tube 26 is to be in fluid communication with the bubble solution container 24 (not depicted in FIG. 6). In this arrangement, bubble solution liquid from the bubble solution container 24 travels through liquid supply tube 26 and into the liquid supply opening 42 of the arcuate bubble blade members 40. From there, the bubble solution liquid travels through liquid supply opening 42 is becomes dispersed along the plurality of grooves 48 located on the inside surfaces of each of the arcuate bubble blade members 40. The plurality of grooves 48 aide in the dispersion of the bubble solution liquid along the inner surfaces of arcuate bubble blade members 40.

Figure 10:
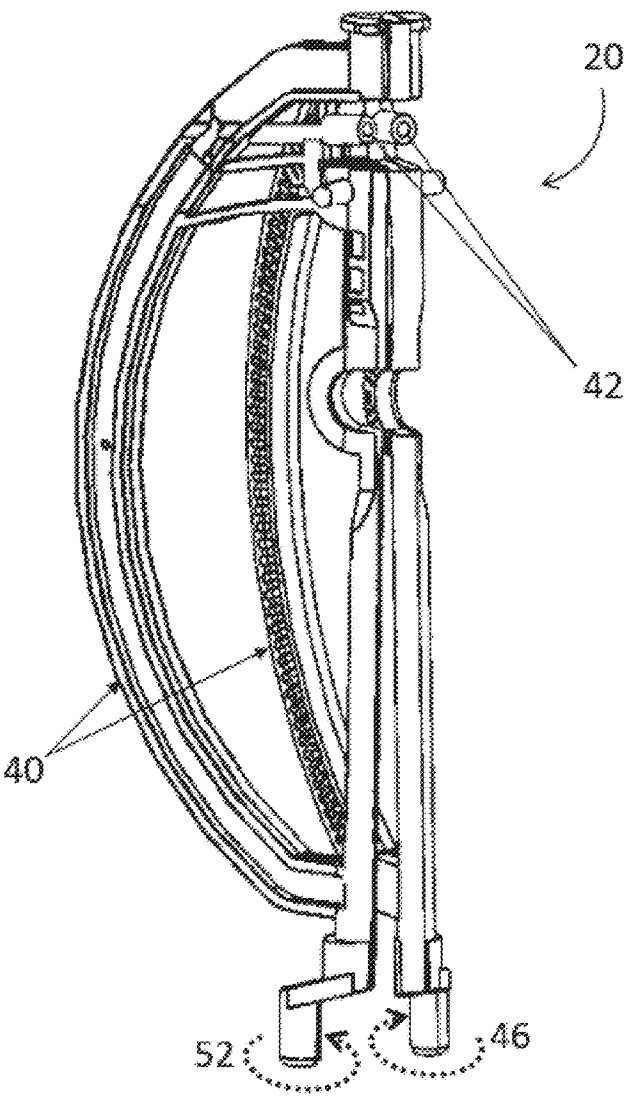
FIG. 10 is an isolated perspective view of an embodiment of a bubble wand in an open position.
Figure 9:
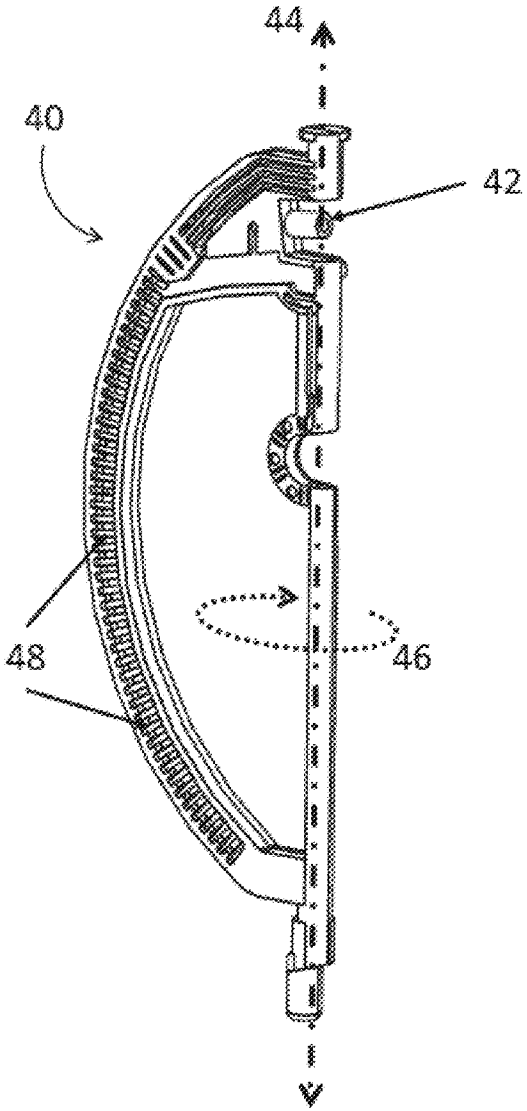
FIG. 9 is an isolated perspective view of an embodiment of an arcuate bubble blade member.

During the bubble making operation of apparatus 100, the bubble wand 20 consistently cycles between a "closed" starting position, in which the plurality of grooves 48 and inner surfaces of each of the bubble blade members 40 are in contact with each other, and an "open" position. Seen in FIG. 10 is an embodiment of the bubble wand in an "open" position. In this "open" position, each of the arcuate bubble blade members 40 are rotated outwardly such that there is a gap between their respective inner surfaces. In transitioning between the open and closed positions, each of the arcuate bubble blade members 40 are constantly rotating back and forth about their own rotational axis 44, from the "closed" starting position to the "open" second position. As seen in FIGS. 9 and 10, when transitioning from the closed starting position to the open second position, arcuate bubble blade members 40 rotate in a direction 46, 52 about rotational axis 44 until they reach a specific predetermined angle of rotation. When transitioning back from the open position to the closed position, the steps are repeated in reverse, and arcuate bubble blade members 40 are rotated about their own independent rotational axis 44, in a direction 46, 52 that runs opposite to the direction 46, 52 they traveled when opening. The transition from open to closed positions is completed once the plurality of grooves 48 and each of the respective inner surfaces of the two arcuate bubble blade members 40 are back in direct physical contact with each other. While each of the arcuate bubble blade member 40 have their own independent rotational axis 44, their rotational axes 44 run parallel to each other.

In some embodiments, the specific amounts that the arcuate bubble blade members 40 are rotated in directions 46 and 52 when transitioning between the two positions is adjustable, which can enable the user to increase or decrease the distance between the respective inner surfaces of the blade members 40 when in they are in the "open" position. Adjusting the distances between the respective inner surfaces of the arcuate bubble blade members 40 when in the open position enables the user to adjust the size of the bubbles that are created and blown therefrom. In an exemplary embodiment, while the arcuate bubble blade members 40 are transitioning from the "closed" position (FIG. 8) to the "open" position (FIG. 10), the fan 16 is actively blowing a stream of air in a direction 50 that runs at least partially through the gap between the inner surfaces of the arcuate bubble blade members 40. When this stream of air 50 comes in contact with the bubble solution that is running along the plurality of grooves 48 between the respective inner surfaces of the bubble blade members 40, a bubble begins to form. As the arcuate bubble blade members 40 each rotate back into the "closed" position, the now fully formed bubble detaches from the end of members 40 and is blown outwards by the stream of air traveling in direction 50. In this manner, it can be understood that a new bubble can be formed each time the arcuate bubble blade members 40 cycle between their open and closed positions.

Thus, although there have been described particular embodiments of the present invention of a new and useful BUBBLE BLOWING TOY, it is not intended that such references be construed as limitations upon the scope of this invention.

What is claimed is:

1. A bubble blowing apparatus comprising:

a main body housing;

a handle integral to a lower portion of the main body housing;

a motor;

a fan operably coupled to the motor, the fan positioned to blow a stream of air in a forward direction outward from a front portion of the main body housing;

a pump mechanism operably coupled to the motor;

a bubble wand operably coupled to the motor, the bubble wand including a first arcuate bubble blade member and a second arcuate bubble blade member that each rotate outwardly in the forward direction and inwardly opposite the forward direction, wherein a top portion of the first arcuate bubble blade member includes a first liquid supply opening and a top portion of the second arcuate bubble blade includes a second liquid supply opening;

a trigger, operable to activate the motor;

a bubble solution container;

a liquid supply tube operably coupled to the pump mechanism and configured to supply liquid from the bubble solution container to each of the first and second liquid supply openings of the bubble wand; and a liquid return tube configured to return excess liquid from the bubble wand to the bubble solution container.

2. The bubble blowing apparatus of claim 1, wherein the motor comprises a battery-powered motor.

3. The bubble blowing apparatus of claim 2, further comprising a liquid return catch basin coupled to the liquid return line.

4. The bubble blowing apparatus of claim 3, wherein the bubble solution container is detachably coupled to a lower portion of the main body housing via a threaded screw-in connection.

5. The bubble blowing apparatus of claim 1, wherein the first arcuate bubble blade member is an identical mirror image of the second arcuate bubble blade member.

6. The bubble blowing apparatus of claim 1, wherein the first arcuate bubble blade member is configured to rotate back and forth about a first rotational axis between a closed starting position and an open first position, and the second arcuate bubble blade member is configured to rotate back and forth about a second rotational axis between the closed starting position and an open second position.

7. The bubble blowing apparatus of claim 6, wherein the first rotational axis runs parallel to the second rotational axis.

8. The bubble blowing apparatus of claim 7, wherein the first arcuate bubble blade member's angle of rotation as measured between the closed starting position and the open first position is equal to the second arcuate bubble blade member's angle of rotation as measured between the closed starting position and the open second position.

9. The apparatus of claim 6, wherein the first arcuate bubble blade member and the second arcuate bubble blade member each include a plurality of grooves.

10. The apparatus of claim 9, wherein the plurality of grooves of the first arcuate bubble blade member and the plurality of grooves of the second arcuate bubble blade member are in contact when the first and second arcuate bubble blade members are in the closed starting position.

11. A method of blowing bubbles, comprising the steps of:

providing a bubble blowing apparatus comprising:

a main body housing, a handle integral to a lower portion of the main body housing, a motor, a fan operably coupled to the motor, the fan positioned to blow a stream of air in a forward direction outward from a front portion of the main body housing, a pump mechanism operably coupled to the motor, a bubble wand operably coupled to the motor, the bubble wand including a first arcuate bubble blade member and a second arcuate bubble blade member that each rotate outwardly in the forward direction and inwardly opposite the forward direction relative to the fan, wherein a top portion of the first arcuate bubble blade member includes a first liquid supply opening and a top portion of the second arcuate bubble blade member includes a second liquid supply opening, a trigger, operable to activate the motor, a bubble solution container, a liquid supply tube operably coupled to the pump mechanism and configured to supply liquid from the bubble solution container to each of the first and second liquid supply openings of the bubble wand, and a liquid return tube configured to return excess liquid from the bubble wand to the bubble solution container;

providing a bubble solution; and rotating the bubble wand via the motor, such that the bubble wand repetitively cycles between (1) a closed starting position in which the bubble wand amasses bubble solution, and (2) an open position in which the amassed bubble solution contacts the outwardly blown stream of air and forms a bubble.

12. The method of claim 11, wherein the motor comprises a battery-powered motor.

13. The method of claim 12, wherein the bubble blowing apparatus further comprises a liquid return catch basin coupled to the liquid return line.

14. The method of claim 13, wherein the bubble solution container is detachably coupled to a lower portion of the main body housing via a threaded screw-in connection.

15. The method of claim 11, wherein the first arcuate bubble blade member is an identical mirror image of the second arcuate bubble blade member.

16. The method of claim 11, wherein the first arcuate bubble blade member is configured to rotate back and forth about a first rotational axis between a closed starting position and an open first position, and the second arcuate bubble blade member is configured to rotate back and forth about a second rotational axis between the closed starting position and an open second position.

17. The method of claim 16, wherein the first rotational axis runs parallel to the second rotational axis.

18. The method of claim 17, wherein the first arcuate bubble blade member's angle of rotation as measured between the closed starting position and the open first position is equal to the second arcuate bubble blade member's angle of rotation as measured between the closed starting position and the open second position.

19. The method of claim 16, wherein the first arcuate bubble blade member and the second arcuate bubble blade member each include a plurality of grooves.

20. The method of claim 19, wherein the plurality of grooves of the first arcuate bubble blade member and the plurality of grooves of the second arcuate bubble blade member are in contact when the first and second arcuate bubble blade members are in the closed starting position.

* * * * *